US006535838B2

(12) United States Patent
Abraham et al.

(10) Patent No.: US 6,535,838 B2
(45) Date of Patent: Mar. 18, 2003

(54) FURNACE DIAGNOSTIC SYSTEM

(75) Inventors: Anthony W. Abraham, Laguna Nigel, CA (US); Joseph G. Raffaelli, La Canada, CA (US); Robert W. Cuomo, Fort Collins, CO (US); Derek Daniel Johnson, Loveland, CO (US); Robert Wayne Lewis, Gardena, CA (US); Eldon Vaughn, Fullerton, CA (US)

(73) Assignee: Robertshaw Controls Company, Richmond, VA (US)

( * ) Notice: Subject to any disclaimer, the term of this patent is extended or adjusted under 35 U.S.C. 154(b) by 0 days.

(21) Appl. No.: 09/772,252

(22) Filed: Jan. 26, 2001

(65) Prior Publication Data

US 2002/0052713 A1 May 2, 2002

Related U.S. Application Data

(60) Provisional application No. 60/178,837, filed on Jan. 28, 2000.

(51) Int. Cl.[7] ..... G06F 11/30; G06F 15/00; G21C 17/00

(52) U.S. Cl. ..... 702/183

(58) Field of Search ..... 702/130, 183, 702/185; 340/539, 555, 825.69; 431/13, 24, 16; 236/46 R, 1 A, 1 EA, 15 R

(56) References Cited

U.S. PATENT DOCUMENTS

| | | | | |
|---|---|---|---|---|
| 4,555,800 A | | 11/1985 | Nishikawa et al. | |
| 4,738,133 A | | 4/1988 | Breckel et al. | |
| 4,824,510 A | | 4/1989 | Grunden et al. | |
| 4,872,828 A | | 10/1989 | Mierzwinski et al. | |
| 4,885,573 A | | 12/1989 | Fry et al. | |
| 4,955,806 A | | 9/1990 | Grunden et al. | |
| 5,237,663 A | | 8/1993 | Srinivasan | |
| 5,269,458 A | | 12/1993 | Sol | |
| 5,319,580 A | | 6/1994 | Sakata et al. | |
| 5,368,471 A | | 11/1994 | Kychakoff et al. | |
| 5,442,553 A | | 8/1995 | Parrillo | |
| 5,445,347 A | | 8/1995 | Ng | |
| 5,481,481 A | | 1/1996 | Fry et al. | |
| 5,496,450 A | | 3/1996 | Blumenthal et al. | |
| 5,515,297 A | | 5/1996 | Bunting | |
| 5,557,549 A | * | 9/1996 | Chang | 702/183 |
| 5,608,657 A | | 3/1997 | Conway et al. | |
| 5,612,904 A | | 3/1997 | Bunting | |
| 5,745,049 A | * | 4/1998 | Akiyama et al. | 340/870.17 |
| 5,761,092 A | | 6/1998 | Bunting | |
| 5,794,549 A | | 8/1998 | Carter | |
| 5,847,671 A | | 12/1998 | Sailer et al. | |
| 5,884,202 A | | 3/1999 | Arjomand | |
| 5,905,784 A | | 5/1999 | Garland et al. | |
| 5,992,037 A | | 11/1999 | Potts | |
| 6,006,167 A | | 12/1999 | Bunting | |
| 6,023,667 A | * | 2/2000 | Johnson | 702/183 |
| 6,176,436 B1 | * | 1/2001 | Gauthier et al. | 236/51 |
| 6,196,467 B1 | * | 3/2001 | Dushane et al. | 236/46 R |

FOREIGN PATENT DOCUMENTS

| | | |
|---|---|---|
| DE | 40 36 417 C1 | 4/1992 |
| DE | 198 06 112 A1 | 8/1999 |

* cited by examiner

*Primary Examiner*—John S. Hilten
*Assistant Examiner*—Demetrius Pretlow
(74) *Attorney, Agent, or Firm*—Fulwider Patton Lee & Utecht

(57) ABSTRACT

A furnace diagnostic system includes sensors that monitor various functions of the furnace. Data generated by such sensors may be stored for subsequent transfer or may be transferred in real time via an infra red link to a remote handheld device with which an analysis thereof is performed. The handheld device additionally allows the technician to control various furnace functions to facilitate the generation of relevant real time data. In order to further enhance the system's diagnostics capabilities, the communication may be established with a centralized computing facility which includes a data base containing data relating to an entire population of similar furnaces.

18 Claims, 20 Drawing Sheets

E1
Park
E1
E2
Park
E2
E14
CIR-N
E14
E3
Line-N
E3
E4
EAC-N
E4
E5
Xfmr-N
E5
E6
Hum-N
E6
E7
Hum-H
E7
E8
Line-H
E8
E9
Xfmr-H
E9
E10
Heat-H
E10
E11
Manual-H
E11
E12
Cool-H
E12
E13
EAC-H
E13
NEUTRALS
LINES
+24VAC
CR1
IN4004
+24VDC!
C1
220µF
50V
R1
10K
GND
+24VAC
CR2
IN4004
R2
1.3K
CR3
5.1V
IN52318
R3
1.0K
+5V1
C3
1µF
50V
P2
INDUCER LINE
IGNITOR LINE
INDUCER LINE
IGNITOR LINE
K1
K2
K3
K4
K5
T1
K
T2
T3
T4
L1
L2
CR4
IN4004
R27
100K
C4
1µF
50V
C5
.033µF
R27
68K
IGNITOR
CURRENT
AD0
A
B Valve Differential Pressure Transducer Filter Differential Pressure Transducer Lockout Code: "FSLK"
Lockout Description: Flame Sense Loskout
Palm Text:

FAULT: Flame Sense Lockout
DESCRIPTION: Flame detected when no flame should be present.
ACTIONS:
1) There should NOT be 24V ac at the valve when there is no call for heat.
> If there is voltage, replace the ignition control.
> If there is no voltage and the valve remains open, replace the gas valve.
2) Check line voltage power.
3) Check line voltage polarity.
4) Check continuity of ground wire.

FIG. 8A

Lockout Code: "VOLK"
Lockout Description: Valve Open Loskout
Palm Text:

FAULT: Valve Open Lockout
DESCRIPTION: Electronic control detected that the valve is open when it should not be.
ACTIONS:
IF THE VALVE IS LETTING GAS FLOW UNCONTROLLED TURN OFF THE GAS SUPPLY!
1) There should NOT be 24V ac at the valve when there is no call for heat.
> If there is voltage, replace the ignition control.
> If there is no voltage and the valve remains open, replace the gas valve.
> If there is no voltage, the valve remains closed, and the lockout condition presists, replace the ignition control.
2) Check for a short between the Line and Neutral of the gas valve terminals.
· If there is no short, replace the ignition control.
· If there is a short, trace its origin and repair.

FIG. 8b

Lockout Code: "VPLK"
Lockout Description: Valve Pulse Lockout
Palm Text:

FAULT: Valve Pulse Lockout
DESCRIPTION: The gas valve does not open.
ACTIONS:
1) The electronic control has detected a fault with the valve watching circuit. Replace the electronic control.

FIG. 8C

Lockout Code: "VSLK"
Lockout Description: Valve Pulse Loskout
Palm Text:

FAULT: Valve Static Lockout
DESCRIPTION: The gas valve does not open.
ACTIONS:
1) The electronic control has detected a fault with the valve watchdog circuit. Replace the electronic control.

FIG. 8D

Lockout Code: "ROLK"
Lockout Description: Rollout Loskout
Palm Text:

FAULT: Rollout Lockout
DESCRIPTION: The system lockouts out preventing a heating cycle from occurring.
1) If flame has rolled out of the burner and tripped the rollout sensing device. shut the system down and call the manufacturer.

FIG. 8E

Lockout Code: "HLLK"
Lockout Description: Hi-Limit Lockout
Palm Text:

FAULT: Hi-Limit Lockout
DESCRIPTION: The system detected an over temperature condition.
ACTIONS:
1) Check for open limit.
2) If the system has overheated
CALL THE MANUFACTURER.

FIG. 8F

Lockout Code: "TRILK"
Lockout Description: Trial Loskout
Palm Text:

FAULT: Trial Lockout
DESCRIPTION: The system failed to light the burner the maximum number of tries.
ACTIONS:
1) Check gas supply.
2) Check manifold pressure. If gas supply pressure is normal and there is no flow from the valve when it should be open, replace the valve.
3) Check for 24V ac across the valve during the ignition sequence. If voltage is present and the valve does not open, replace the valve.
4) Check for 24V ac at the valve terminal(s) on the ignition control. If voltage is present on the control and not at the valve, cleck the wiring between them. If no voltage is present, replace the ignition control.
5) Check ignition position. Adjust or replace is necessary.
6) Check flame probe position. Adjust or replace if necessary.

FIG. 8G

Lockout Code: "PSWLK"
Lockout Description: Pressure Switch Lockout
Palm Text:

FAULT: Pressure Switch Lockout
DESCRIPTION: The pressure switch closure was not detected during purge.
ACTIONS:
1) Check line voltage level.
2) Check low voltage transformer.
3) Check for voltage to induced draft motor.
4) Check for 24V ac from terminal "W" to "C" on the control.
5) Check that the pressure switch is OPEN when the inducer is OFF.
6) Check that the pressure switch is CLOSED when the inducer is ON.
7) Check that system limits are closed.
8) Check wiring between control, induced draft motor, and pressure switch.
9) Check for a blocked vent.

FIG. 8H

Lockout Code: "IGNLK"
Lockout Description: Ignition Loskout
Palm Text:

FAULT: Ignition Lockout
DESCRIPTION: The ignitor could not be proven after all of the ignition trials.
ACTIONS:
1) Check line voltage level.
2) Check for voltage to ignitor.
3) Check for ignitor current to control.
4) Check ignitor resistance.
5) Check wiring between control and ignitor.

FIG. 8I

Lockout Code: "RCYLK"
Lockout Description: Recylcle Lockout
Palm Text:

FAULT: Recycle Lockout
DESCRIPTION: The maximum number of recycles after flame loss has expired.
ACTIONS:
1) Check line voltage powere.
2) Check line voltage polarity.
3) Check continuity of ground wire.
4) Check insulation of ignitor leads.
5) Check flame sense current. If flame current is marginal:
> Turn power off to unit.
> Clean flame sensor with steel wool.
> Restore power to the unit and try again.
6) Check wiring between control and ignitor.

FIG. 8J

FAULT: Marginal Flame Current
Palm Text:

FAULT: Marginal Flame Lockout
DESCRIPTION: The flame current is at a marginal level.
ACTIONS:
> Turn power off to Unit
> Clean flame sensor with steel wool.
> Restore power to the unit and try again.
If flame current is still marginal:
1) Check line voltage power.
2) Check line voltage polarity.
3) Check fcontinuity of ground wire..
4) Check wiring between control and flame ignitor.

FIG. 8K

FAULT: Dirty Filter
Palm Text:

FAULT: Dirty Filter Detected
DESCRIPTION: The system detected a dirty filter.
ACTIONS:
1) Clogged filter is likely. Clean or replace filter.
2) Check the installation for flow through the circulation fan.

FIG. 8L

FAULT: Low Manifold Pressure
Palm Text:

FAULT: Low Manifold Pressure
DESCRIPTION: The system detected a manifold pressure below 3.2 inches w.c..
ACTIONS:
1) Check supply pressure.
2) If supply is within proper limits replace the gas valve.

FIG. 8M

FURNACE DIAGNOSTIC SYSTEM

This application claims the benefit of Provisional Application No. 60/178,837, filed Jan. 28, 2000. A computer program listing appendix on compact disc is included in this application.

A computer program listing appendix on compact disc is included in this application.

BACKGROUND OF THE INVENTION

The present invention generally relates to residential furnace diagnostic systems. More particularly, the invention pertains to a method for measuring, storing, reporting and analyzing furnace diagnostic information as well as the electronic circuitry and software capable of implementing such method.

The complexity of modern heating systems has complicated the diagnosis and repair of faults from which such systems may suffer. Misdiagnosis and the replacement of the wrong components is both expensive and time consuming and can pose a substantial nuisance to all involved. On the one hand, the homeowner is subjected to a continued malfunction of the heating system and must accommodate repetitive service calls. On the other hand, the service provider must expend time and labor to repeatedly send personnel into the field to address the problem while the furnace manufacturer may be called upon to supply replacements for components that are in fact fault free and fully operational.

Some progress has previously been made to facilitate a more comprehensive analytical approach to the operation of furnace systems and to thereby allow problems to be more quickly and efficiently diagnosed and the underlying faults to be correctly identified. This has included both the modification of furnace configurations to actively accommodate the monitoring of various functions as well as the development of external analytical tools that are capable of probing the operation of existing furnace systems. However, none of the heretofore known approaches have provided an adequately comprehensive system that exploits all of the tools that are currently available to thereby allow problems to be identified as quickly and accurately as possible.

In certain previously known systems, monitoring and diagnostic systems have been integrated within a furnace to thereby provide for a data collection and memory capability. Operating data, including malfunctions are logged and can be accessed by a service technician using a portable, hard-wired data reading unit.

Other systems have been devised wherein an integrated electronic furnace control arrangement incorporates a self test feature which shuts down the furnace in the event of any one of a number of possible sensed faults. This system tests furnace sensors for false indications both while the sensor should be detecting a particular burner parameter as well as when the sensor should not be sensing that parameter and in the event of a discrepancy, performs a safety interrupt and lockout command to shut down the furnace. Additional features that may be present include a multipurpose display for selectively showing component indicative failure codes, temperature setback schedules, time of day, and day of the week.

Systems have been described that incorporate a direct ignition gas burner control system using a microcomputer and related circuitry for controlling the energizing of the ignitor and valves and for numerous checks on the integrity of the system components. Such systems may include an ignition control processor which transmits coded data signals to a portable display module via a hard-wire conduit connection. The portable display module contains a processor to process the signals received from the ignition control processor and to control a display device to display selected operating modes and last known failure conditions in human-readable form. Residence appliance management and communication systems are also known that include an interface module installed on each home appliance. In the case of the furnace, the interface module interfaces with the furnace microprocessor and reports furnace component status and failures to a central controller.

However, while such systems aid in the diagnosis of certain faults a furnace may suffer from, none of the systems that have previously been described enable a technician to enjoy the full benefit of computerized analysis of real time as well as historical data. A system is needed wherein all such capabilities can simultaneously be brought to bear on a particular problem to allow an underlying fault to be quickly and accurately identified. Such system must not only be efficient in its operation but must be easy to transport and use in the field.

SUMMARY OF THE INVENTION

The present invention provides a novel method and apparatus for acquiring, reporting and analyzing diagnostic information for furnaces to facilitate troubleshooting and repair. The invention is couched in the recognition that a number of different factors can contribute to a misdiagnosis, including a technician's inability to quickly and easily test a system's various functions to thereby identify faults in real time. Additionally, in the event a particular failure mode is intermittent, an inability to recall the circumstances relating to previous malfunctions can prevent positive identification of the problem. A technician's unfamiliarity with the failure and repair history of the particular unit subject to the malfunction may additionally inhibit a quick and accurate diagnosis. Finally, the inability to quickly and properly analyze a particular set of symptoms in the context of the past history of the individual heating system as well as the whole population of such systems may thwart efforts to accurately diagnose and hence quickly and efficiently remedy a particular problem.

The present invention addresses each of the above-described sources of or reasons for misdiagnosis. Moreover, the invention enables a technician to quickly and easily generate and retrieve all relevant data from the furnace and avails the analytical power of remote diagnostic facilities to analyze the data. As such, the system of the present invention includes various sensors that are integrated throughout a furnace that monitor its various functions, is capable of storing data generated by such sensors to create a fault history and allows a technician to access such data via a remote, handheld device. The handheld device additionally allows the technician to control the system's various functions and thereby generate real time data relevant to its operation. The handheld device serves to analyze the data to diagnose the underlying problem. Finally, the system allows data to be transferred to a remote centralized computing facility for further processing. Such centralized facility is capable of storing a large body of data pertaining to the operation and fault history of the entire population of individual furnace systems in the field. The ability to draw from such database provides further assistance for the technician to enable him to more quickly and accurately correlate a particular set real time and/or historical data with an underlying fault.

Thus, briefly and in general terms, in one aspect the present invention is directed to a plurality of sensors in combination with electronic circuitry for measuring various furnace parameters.

In another aspect, a software system is provided to reside on a microcontroller and interface with the electronic circuitry to access the acquired diagnostic information, and to further interface with a portable handheld device to provide the information to a system user.

In another aspect, electronic circuitry and software is provided that is capable of storing data pertaining to the operation of the furnace for future access thereto.

In a further aspect, the invention consists of a microcontroller based furnace controller for a residential furnace with various sensors and a wireless hand held display device (such as a PalmOS™ device). Both real time data as well as stored historical data is accessible by the handheld device for analysis. The invention thereby makes the integrates detailed diagnostic information and the latest in computing technology for the benefit of the service technician.

In another aspect, the invention imparts an ability to the technician to control the operation of the furnace via the handheld device to thereby generate real time data points without having to physically access the furnace control circuits.

Finally, in a further aspect, the invention provides for the storage of and access to performance/fault data from a population of similar furnace systems in a centralized database to further enhance the systems's diagnostic ability.

These and other features and advantages of the present invention will become apparent from the following detailed description of preferred embodiments, which taken in conjunction with the accompanying drawings, illustrate by way of example the principles of the invention.

BRIEF DESCRIPTION OF THE DRAWINGS

FIGS. 8A–M depict the various lockout codes, and associated diagnostic messages presented to the user, including possible actions to be taken by the user, associated with the LOCKOUT control diagram of FIG. 6.

DETAILED DESCRIPTION OF THE PREFERRED EMBODIMENT

The present invention discloses a new method of communicating controls and historical as well as real-time diagnostic information between a residential furnace controller and a portable hand held device carried by a service technician. The system provides a method of interrogating the furnace while operating, diagnosing the real time information as well as stored historical data on the furnace operations, controlling furnace components and monitoring the resulting response in real-time, and providing knowledge based troubleshooting assistance to the service technician in an expeditious manner. One preferred embodiment of the method provides infrared communication ports on the furnace controller and handheld device to obviate the need to make physical attachments to the furnace. A wireless link not only makes access quicker and more convenient but allows electronic controls to be accessed without the risk of inadvertently affecting the operation of the furnace control circuitry with physical attachments which may possibly mask the cause of a malfunction. The handheld device, containing a microcontroller, display, and keyboard, provides the logic that interprets the diagnostic information from the furnace and presents the field technician with instructions for troubleshooting and quickly repairing malfunctions. The system also allows a centralized computing facility with a performance/fault database pertaining to an entire population of such furnace systems to be accessed to further enhance the system's diagnostics capability.

Figure 1:
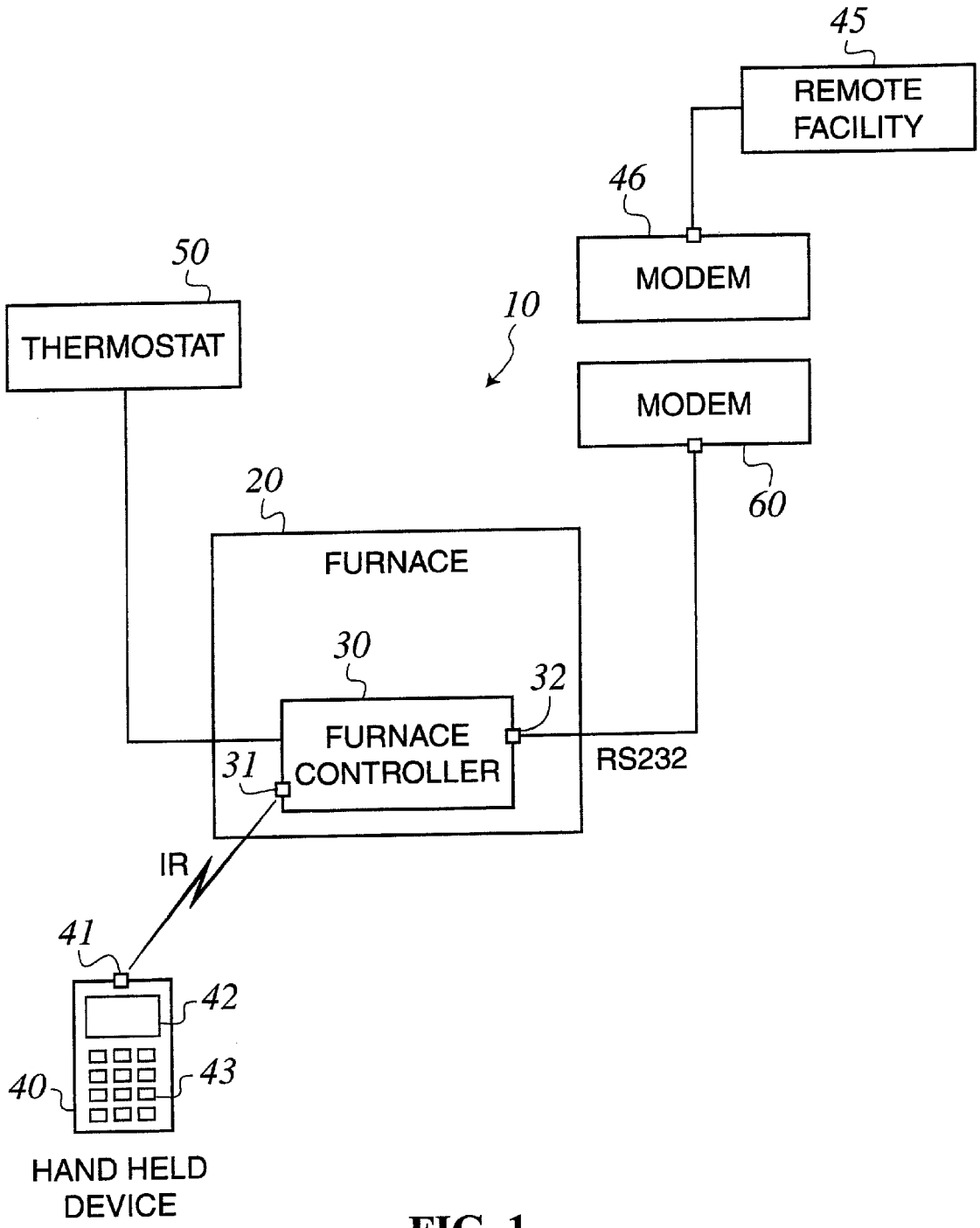
FIG. 1 presents a block diagram of a furnace diagnostic system in accordance with the present invention.
Figure 2:
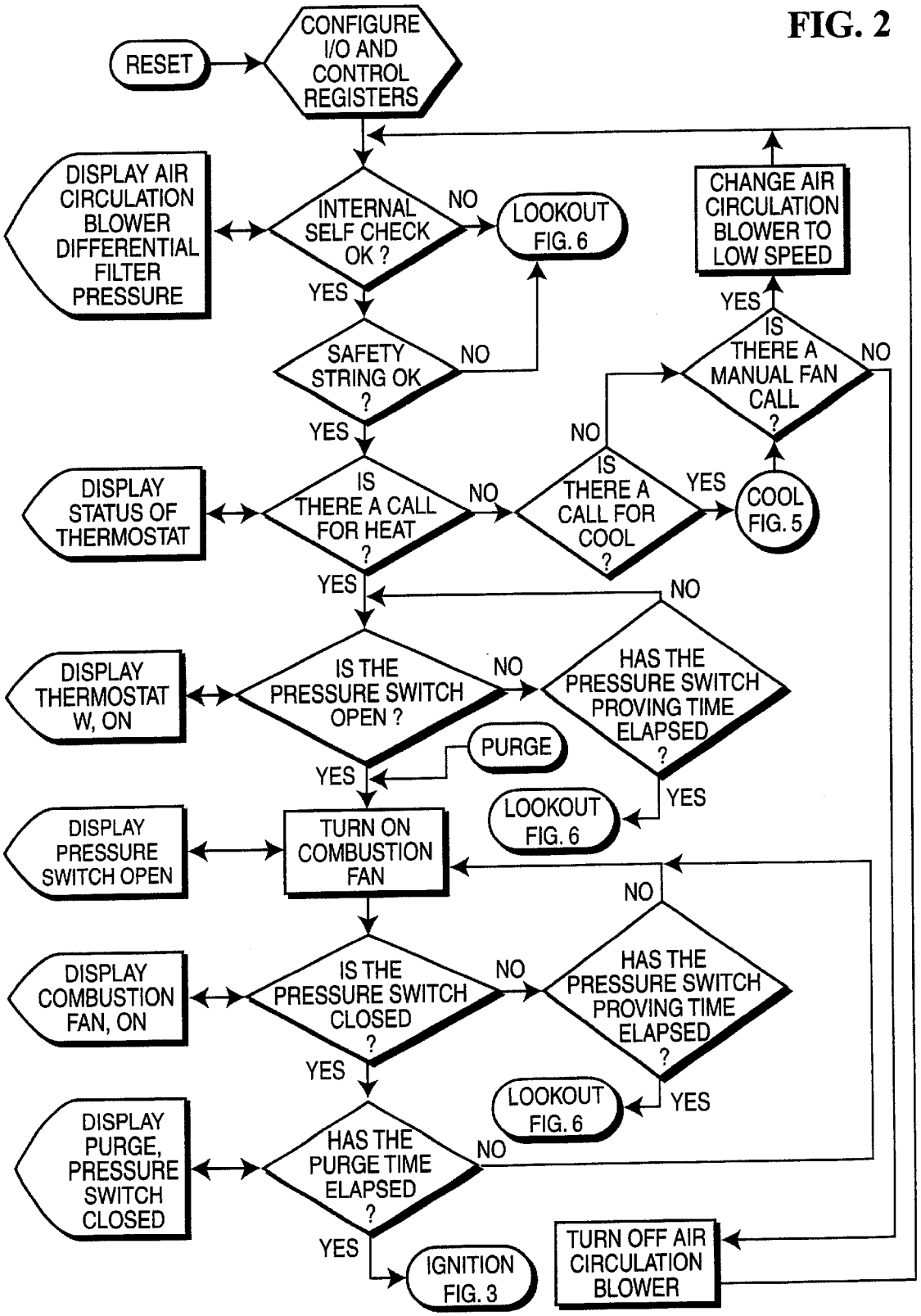
FIG. 2 is a logic control diagram depicting generally the method of the present invention.

Thus, in one preferred embodiment, as shown in FIG. 1, the present invention is directed to an electronic control system 10 and associated software for use as a diagnostic tool in a residential furnace application targeted for 100,000 BthU, 80% efficiency residential furnaces. The invention provides a detailed diagnostic capability to a residential furnace controller 30 installed on the furnace 20. During normal operations, the furnace controller 30 interfaces with thermostat 50 to receive manual furnace control signals and also interfaces with furnace control elements and sensors to provide the required operation. During troubleshooting and diagnostic operations, an infrared communication port 31 on the furnace controller interfaces via an infrared link with an infrared communication port 41 on the service technician's handheld device 40. Using the infrared link, the service technician has the ability to read troubleshooting advice on the hand held device 40 display 42 and issue commands using the hand held device 40 key pad 43 at the same time that the furnace 20 is operating. The hand held device 40 uses a knowledge base to correlate the types of errors found and gives the technician suggestions about where to start looking for problems. This helps identify at what point in the control cycle there is a failure and what component or subsystem could be the cause. The system additionally includes a centralized computing facility 45 with which is accessible via modem 60. Such facility includes a database of the fault history of the entire population of similar furnaces as well as advance diagnostics capabilities to thereby extend the diagnostic capability of the handheld device.

As shown in FIGS. 2–6, the system provides the following diagnostic support:

- Furnace Control Status: The furnace controller 30 communicates to the hand held device 40 the current state of the control system.
- Real-time Help: The hand held device 40 correlates the current state of the control system to the appropriate potential problem causes in the troubleshooting scheme.
- Inducer Function: In addition to automatic monitoring, the technician can turn on the inducer fan and "see" the state of the pressure switch when the controller does.
- Ignitor Function: In addition to automatic monitoring, the technician can turn on the hot surface ignition device and "see" the amount of current drawn.

Manifold Pressure: In addition to automatic monitoring, the technician can monitor the magnitude of the manifold gas pressure.

Filter Differential Pressure: In addition to automatic monitoring, the technician can monitor the pressure differential across the filter for identifying a clogged filter.

Ignition Function: In addition to automatic monitoring, the technician can launch an ignition sequence to observe events or troubleshoot a particular component.

Circulation Function: In addition to automatic monitoring, the technician can turn on the various speeds of the circulation blower to aid in troubleshooting the motor.

Read Thermostat Signals: In addition to automatic monitoring, the technician can verify the signals that the furnace controller 30 "sees" from the thermostat 50.

With reference now to FIG. 7, the electronic circuit diagram depicts the preferred embodiment of a control device for performing the method of the invention. The controller contains a 24V DC power supply consisting of diode CR1 and capacitor C1. The 24V DC power supply provides power to the relays. The controller also has a 5V DC power supply consisting of diode CR2, three-terminal 5V regulator U11, and capacitor C2. The 5V DC power supply provides power to the rest of the circuit.

A relay driver, U3, is used to pull-down the relays to ground. In order to give additional protection from a fault enabling the gas valve relay K6, a 1 kHz signal is applied to an integrator to bias on the relay driver for the gas valve. The integrator consists of capacitors C6 and C7, diodes CR3 and CR4, and resistors R30 and R31. This integrator, in conjunction with a steady signal applied from the microprocessor U1 through resistor R13 to the base of the transistor Q1, provides the ground path to the gas valve relay K6. Another unique and novel feature of this circuit is the ability to verify the condition of transistor Q1 and the relay driver U3. This is accomplished by providing a 2.5V DC reference signal through resistor R34 and reference diode CR13. This 2.5V DC signal is fed through resistor R33 to the net between the emitter of Q1 and the open collector output of U3. The signal is also fed back to an analog input of the microprocessor U1. If both of these drivers are off, the 2.5V DC signal can be read by the microprocessor and can be used as a calibration for the analog to digital converter. If transistor Q1 is turned on the signal will rise to near 5V DC. If the relay driver, U3, is turned on by feeding a 1 kHz signal to the integrator, the signal at the microprocessor will be reduced to approximately 0.7V DC.

Transformer T1, diode CR11, capacitors C4 and C5, and resistors R54 and R55 generate a voltage that is proportional to the igniter current. This voltage is fed into an analog input to the microprocessor. This allows the microprocessor to measure the igniter current.

The circuit also uses a unique method of measuring flame current. The flame sense circuit consists of capacitors C8 and C9, resistors R23, R24, R25, R26, R27 and R28, and transistors Q2 and Q3. An AC signal is fed to the flame sense circuit by capacitor C8. In the presence of flame, a negative DC current will be introduced on the flame sense input. This DC current is enough to discharge capacitor C9 until it is low enough to bias the FET Q3 off, thus indicating the presence of flame. The circuit is automatically adjusted to its maximum sensitivity by the microprocessor pulsing transistor Q2 on and off. When transistor Q2 is turned on, capacitor C9 is charged to 5V DC. The pulse width of the signal going to transistor Q2 starts at a 50% duty cycle. If flame is not detected, the duty cycle is decreased by a factor of two repeatedly until flame is detected. Then the pulse duty cycle is gradually increased until C9 is discharged sufficiently to bias the FET Q3 on and flame sense is no longer detected. The pulse width just before flame sense is no longer detected is directly proportional to the flame current.

The circuit also has two pressure transducers that are interfaced to the microprocessor U1. These pressure transducers, U6 and U7, are amplified through U2 and various gain resistors to provide an analog voltage on the microprocessor that is proportional to the pressures being measured.

The standard external thermostat 50 contacts R, W, Y, and G are monitored to determine if the thermostat is calling for heat, cool, or if a manual fan is on. The inputs from the thermostat contacts are resistor divided and are clamped to the 5V DC and ground levels through the diode array U8. Also, the circuit monitors the high limit thermostat, rollout switches, and a pressure switch. These inputs are also resistor divided and clamped to 5V DC and ground by diode array U8 and diodes CR12 and CR13.

Within the furnace controller 30, the circuitry for controlling and monitoring functions such as air circulation blower heat speed, cool speed and manual fan speed, igniter, gas valve, and induced draft blower are connected to connector blocks or terminals for easy connection to a furnace. A four-position DIP-switch is used to select various fan on and off delays. The circuit also has a flash programming port. This allows the microprocessor to be reprogrammed while in circuit.

The circuit also has methods of communicating to other computers. The first method is through an IRDA interface. The serial input and output leads from the microprocessor are routed through analog bilateral switch U9 to the HSDL-7001 infrared communications controller U4. U4 then connects to HSDL-3610, an infrared transolver that provides the infrared input and output of the circuit. This infrared communications port is shown as item 31 in FIG. 1. The other method of external communications is with an RS232 interface. A DCE RS232 connection is accomplished by taking the serial input and output leads from the internal UART of the microprocessor and switching them through the analog bilateral switch U9 to the MAX232E, U10. RS232 voltage levels are attained through U10 and capacitors C10, C11, C12 and C13. These signals are then routed to the SUB-D9 connector. This port is shown as item 32 in FIG. 1 and can be used to connect to a modem 60 so that historical data can also be gathered over a phone line or over the Internet.

The communication capabilities provided above are one of the important novel features of the method and device of the present invention, and they allow the control device to be accessed through either the IRDA interface 31 or the RS232 interface 32. This access provides the service technician the capability to troubleshoot the furnace controller 30 and measure various parameters without touching any of the circuits. In a preferred embodiment, a software interface is implemented on a hand held device 40 that allows the technician to operate portions of the furnace controller circuit on demand, as well as identify possible problems through various diagnostic messages displayed on the hand held device display 42 as shown in FIGS. 8A–M. This greatly enhances the technician's ability to troubleshoot and diagnose what is wrong with the circuit. The software also allows the technician to generate a call for heat, in which instance the controller 30 operates as if the thermostat 50 has been turned up and a call for heat has been generated.

The two-way interface also provides real time data on the conditions within the appliance (e.g. the furnace). The igniter current, flame sense current, manifold pressure, inlet pressure, etc. can be read in real time. When a call for heat is generated, the handheld device 40 can display all of the measured information in real time.

The controller 30 microprocessor U1 also stores historical data. The historical data is then transferred to the handheld device 40. This data can then be archived to provide information on the history of the controller. Data such as number of cycles, number of successful ignition cycles on first attempt, second attempt, third attempt and number of times in various lockouts, flame sense loss, etc. is stored for later retrieval. The controller gives this data over the life of the controller and since the last interrogation by the handheld device 40.

The following is a summary of the software features:

1. The software is designed for safety critical applications and will be compliant with Underwriters Laboratory (UL) 1998 table 7 specification for software safety. Other features are added above and beyond UL 1998 to ensure reliability and robust performance.

Software recovery from noise and transients. This enables recovery without a hard reset if possible.

2. The software is designed as a state machine controlling all stages of gas ignition in furnace applications.

WAIT STATE

PRE PURGE STATE

WARMUP STATE

IGNITION STATE

BURNER STATE

INTER PURGE STATE

POST PURGE STATE

COOL STATE

3. The software kernel is designed to be generic in order to function in multiple hardware configurations.

All port I/O in the main kernel program is generic in order to add a layer of abstraction to port definitions.

Software library routines are used to assign port definitions for specific products. This allows new products to be added without changing the main kernel software.

All configuration information will be read from EEPROM in order for the main kernel program to remain generic.

4. The software is designed to provide the following diagnostic capability to a hand held device 40 via an infrared port:

Real-time data availability on the hand held device display 41.

System State and timings
   Ignitor Current
   Flame Current
   Gas Inlet Pressure
   Gas Valve Differential Pressure
   Manifold Pressure
   Air Filter Differential Pressure System primitive activation capability from the hand held device 40 for troubleshooting ACB Manual Fan On/Off
   ACB Heat Speed On/Off
   ACB Cool Speed On/Off
   Inducer blower On/Off with pressure switch Open/Closed feedback
   Igniter On/Off with amperage reading Historical data will be available to the hand held device 40. This will include data relating to all critical aspects of furnace control and maintenance over time.

Number of heat, cool, and manual fan cycles
   Number of first, second, and third ignition attempts
   Number of retries following flame loss
   Lockouts and associated reasons for error Appendix A attached hereto contains a listing of source code for the software system described above. In particular, the HEADER program contains configuration data for implementing the method of the invention on an Atmel microcontroller, MAIN contains the functional code for operating the system, PROTO contains function prototypes used by the compiler to define for the compiler which functions to compile, RF2001 contains application specific definitions such as which microcontroller pins are assigned to what functions in the system, and SERIAL contains the code necessary for the infrared and RS232 communication for the system.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A furnace diagnostic system for facilitating the troubleshooting of malfunctions in the operation of a furnace, comprising:

sensors disposed within said furnace for monitoring various parameters associated with the operation of said furnace;

electronic circuitry for transmitting by wireless means data generated by said sensors, for storing data generated by said sensors and for controlling the operation of said furnace pursuant to commands received by wireless means;

a handheld device for receiving by wireless means data from said electronic circuitry, for transmitting commands to said electronic circuitry by wireless means to control the operation of said furnace and for analyzing data received from said circuitry so as to provide guidance for identifying faulty components that may underlie a particular malfunction of said furnace; and a centralized computing facility capable of storing historical data relating to a population of furnaces wherein said hand held device is capable of communicating with such facility to enhance its ability to diagnose malfunctions of said furnace.

2. The diagnostic system of claim 1, wherein said centralized computing facility is further capable of providing diagnostic assistance to said handheld device.

3. The diagnostic system of claim 1, wherein said parameters monitored by said sensors include ignitor operation and burner operation.

4. The diagnostic system of claim 1, wherein said handheld device is capable of performing diagnostics by controlling operations of said furnace.

5. The diagnostic system of claim 1, wherein said handheld device is capable of performing diagnostics based on historical data stored by said electronic circuitry.

6. The diagnostic system of claim 1, wherein said handheld device is capable of performing diagnostics based on real time data generated by said electronic circuitry.

7. A furnace diagnostic system for facilitating the troubleshooting of malfunctions in the operation of a furnace, comprising:

sensors disposed within said furnance for monitoring various parameters associated with the operation of said furnace;

electronic circuitry for transmitting by wireless means data generated by said sensors, for storing data generated by said sensors and for controlling the operation of said furnace pursuant to commands received by wireless means; and a handheld device for receiving by wireless means data from said electronic circuitry, for transmitting commands to said electronic circuitry by wireless means to control the operation of said furnace and for analyzing data received from said circuitry so as to provide guidance for identifying faulty components that may underlie a particular malfunction of said furnace, wherein said handheld device is capable of performing diagnostics based on data stored in a centralized computing facility with which said handheld device is able to communicate.

8. The diagnostic system of claim 4, wherein said handheld device is further capable of performing diagnostics based on historical data stored by said electronic circuitry.

9. The diagnostic system of claim 8, wherein said handheld device is further capable of performing diagnostics based on real time data generated by said electronic circuitry.

10. A furnace diagnostic system for facilitating the troubleshooting of malfunctions in the operation of a furnace, comprising:

sensors disposed within said furnace for monitoring various parameters associated with the operation of said furnace;

electronic circuitry for transmitting by wireless means data generated by said sensors, for storing data generated by said sensors and for controlling the operation of said furnace pursuant to commands received by wireless means; and a handheld device for receiving by wireless means data from said electronic circuitry, for transmitting commands to said electronic circuitry by wireless means to control the operation of said furnace and for analyzing data received from said circuitry so as to provide guidance for identifying faulty components that may underlie a particular malfunction of said furnace, wherein said handheld device is capable of performing diagnostics by controlling operations of said furnace and wherein said handheld device is further capable of performing diagnostics based on historical data stored by said electronic circuitry, real time data generated by said electronic circuitry and on data stored in a centralized computing facility with which said handheld device is able to communicate.

11. The diagnostic system of claim 5, wherein said handheld is device is further capable of performing diagnostics based on real time data generated by said electronic circuitry.

12. A furnace diagnostic system for facilitating the troubleshooting of malfunctions in the operation of a furnace, comprising:

sensors disposed within said furnace for monitoring various parameters associated with the operation of said furnace;

electronic circuitry for transmitting by wireless means data generated by said sensors, for storing data generated by said sensors and for controlling the operation of said furnace pursuant to commands received by wireless means; and a handheld device for receiving by wireless means data from said electronic circuitry, for transmitting commands to said electronic circuitry by wireless means to control the operation of said furnace and for analyzing data received from said circuitry so as to provide guidance for identifying faulty components that may underlie a particular malfunction of said furnace, wherein said handheld device is capable of performing diagnostics based on historical data stored by said electronic circuitry, real time data generated by said electronic circuitry and data stored in a centralized computing facility with which said handheld device is able to communicate.

13. A furnace diagnostic system for facilitating the troubleshooting of malfunctions in the operation of a furnace, comprising:

sensors disposed within said furnace for monitoring various parameters associated with the operation of said furnace;

electronic circuitry for transmitting by wireless means data generated by said sensors, for storing data generated by said sensors and for controlling the operation of said furnace pursuant to commands received by wireless means; and a handheld device for receiving by wireless means data from said electronic circuitry, for transmitting commands to said electronic circuitry by wireless means to control the operation of said furnace and for analyzing data received from said circuitry so as to provide guidance for identifying faulty components that may underlie a particular malfunction of said furnace wherein said handheld device is capable of performing diagnostics based on real time data generated by said electronic circuitry and on data stored in a centralized computing facility with which said handheld device is able to communicate.

14. The diagnostic system of claim 4, wherein said handheld device is further capable of performing diagnostics based on real time data generated by said electronic circuitry.

15. A furnace diagnostic system for facilitating the troubleshooting of malfunctions in the operation of a furnace, comprising:

sensors disposed within said furnace for monitoring various parameters associated with the operation of said furnace;

electronic circuitry for transmitting by wireless means data generated by said sensors, for storing data generated by said sensors and for controlling the operation of said furnace pursuant to commands received by wireless means; and a handheld device for receiving by wireless means data from said electronic circuitry, for transmitting commands to said electronic circuitry by wireless means to control the operation of said furnace and for analyzing data received from said circuitry so as to privde guidance for identifying faulty components that may underlie a particular malfunction of said furnace wherein said handheld device is capable of performing diagnostics based on real time historical data stored by said electronic circuitry and on data stored in a centralized computing facility with which said handheld device is able to communicate.

16. A method to assist a service technician in diagnosing faults in a furnace while it is operating, said method comprising the steps of:

providing a furnace mounted controller containing a microcontroller and electronic circuitry for monitoring furnace control commands, controlling furnace operations in response to these commands, monitoring and conditioning a plurality of furnace sensor signals, converting furnace data to IRDA format, transmitting such information through an infrared communication port for external use, and receiving external commands in IRDA format through said infrared port and converting to electrical signals; providing software resident on said microcontroller, said software designed as a state machine controlling all stages of furnace operations and performing diagnostics on furnace data;

using said microcontroller for acquiring furnace data from said electronic circuitry, storing said data, performing diagnostics on said data, providing furnace system control instructions to said electronic circuitry, and providing real time and historical data to said electronic circuitry for conversion to IRDA format and transmittal through an infrared communication port for external use;

receiving said information on a wireless hand held device containing a knowledge base and performing multiple levels of diagnostics, including controlling the said furnace controller from the hand held device, gathering historical data from the said furnace controller, gathering real time data from the said furnace controller, and analyzing data gathered from said furnace controller to determine which component or components are the cause of the malfunction and displaying this information to the service technician; and guiding the service technician through repair steps determined by the knowledge base resident in the hand held device and the data received from the furnace controller.

17. A method to assist a service technician in diagnosing faults in an ignition system of a residential furnace while it is operating, said furnace having an inducer fan with pressure switch, an ignition device, manifold gas pressure sensor, filter differential pressure sensor, circulation blower, gas valve, and thermostat, said method comprising the steps of:

providing a furnace mounted controller containing a microcontroller and electronic circuitry for monitoring furnace control commands, controlling furnace operations in response to these commands, monitoring and conditioning a plurality of furnace sensor signals, converting furnace data to IRDA format, transmitting such information through an infrared communication port for external use, and receiving external commands in IRDA format through said infrared communication port and converting to electrical signals;

providing software resident on said microcontroller, said software designed as a state machine controlling all stages of furnace ignition and performing diagnostics on furnace data;

using said microcontroller for acquiring furnace data from said electronic circuitry, storing said data, performing diagnostics on said data, providing furnace system control instructions to said electronic circuitry, and providing real time and historical data to said electronic circuitry for conversion to IRDA format and transmittal through an infrared communication port for external use;

receiving said information on a wireless hand held device containing a knowledge base capable of performing multiple levels of diagnostics, including controlling said furnace controller from the hand held device, gathering historical data from the said furnace controller, gathering real time data from the said furnace controller, and analyzing the data gathered from the said furnace controller and determining which component or components are the cause of the malfunction and displaying this information to the service technician;

guiding the service technician through repair steps determined by the knowledge base resident in the hand held device and the data received from the furnace controller.

18. A method to assist a service technician in diagnosing faults in an ignition system of a residential furnace while it is operating, said furnace having an inducer fan with pressure switch, an ignition device, manifold gas pressure sensor, filter differential pressure sensor, circulation blower, gas valve, and thermostat, said method comprising the steps of:

providing a furnace mounted controller containing a microcontroller and electronic circuitry for monitoring furnace control commands, controlling furnace operations in response to these commands, monitoring and conditioning a plurality of furnace operations in response to these commands, monitoring and conditioning a plurality of furnace sensor signals, converting furnace data to IRDA format, transmitting such information through an infrared communication port for external use, and receiving external commands in IRDA format through said infrared communication port and converting electrical signals, wherein said electronic circuitry contains a flame current measuring circuit which, in conjunction with logic contained in the microcontroller, determines flame current by applying an AC signal and a microcontroller controlled pulse to a circuit which also receives a negative current from a flame sensor, and pulse providing positive current proportional to duty cycle to the flame present indicator circuit tending to turn off a flame present indicator, such flame sensor providing negative current to the flame present indicator circuit tending to turn on the flame present indicator, such pulse duty cycle starting at a nominal value and, if flame is not detected, being halved repeatedly until flame is detected, then being increased gradually until flame presence is no longer detected, the pulse width just before the flame is no longer detected being directly proportional to the flame current;

providing software resident on said microcontroller, said software designed as a state machine controlling all states of furnace ignition and performing diagnostics on furnace data;

using said microcontroller for acquiring furnace data from said electronic circuitry, storing said data, performing diagnostics on said data, providing furnace system control instructions to said electronic circuitry and providing real time and historical data to said electronic circuitry for conversion to IRDA format and transmittal through an infrared communication port for external use;

receiving said information on a wireless hand held device containing a knowledge base capable of performing multiple levels of diagnostics, including controlling said furnace controller from the hand held device, gathering historical data from the said furnace controller, gathering real time data from the said furnace controller, and analyzing the data gathered from the said furnace controller and determining which component or components are the cause of the malfunction and displaying this information to the service technician; and guiding the service technician through repair steps determined by the knowledge base resident in the hand held device and the data received from the furnace controller.

* * * * *

UNITED STATES PATENT AND TRADEMARK OFFICE

CERTIFICATE OF CORRECTION

PATENT NO. : 6,535,838 B2
DATED : March 18, 2003
INVENTOR(S) : Abraham et al.

Figure 3:
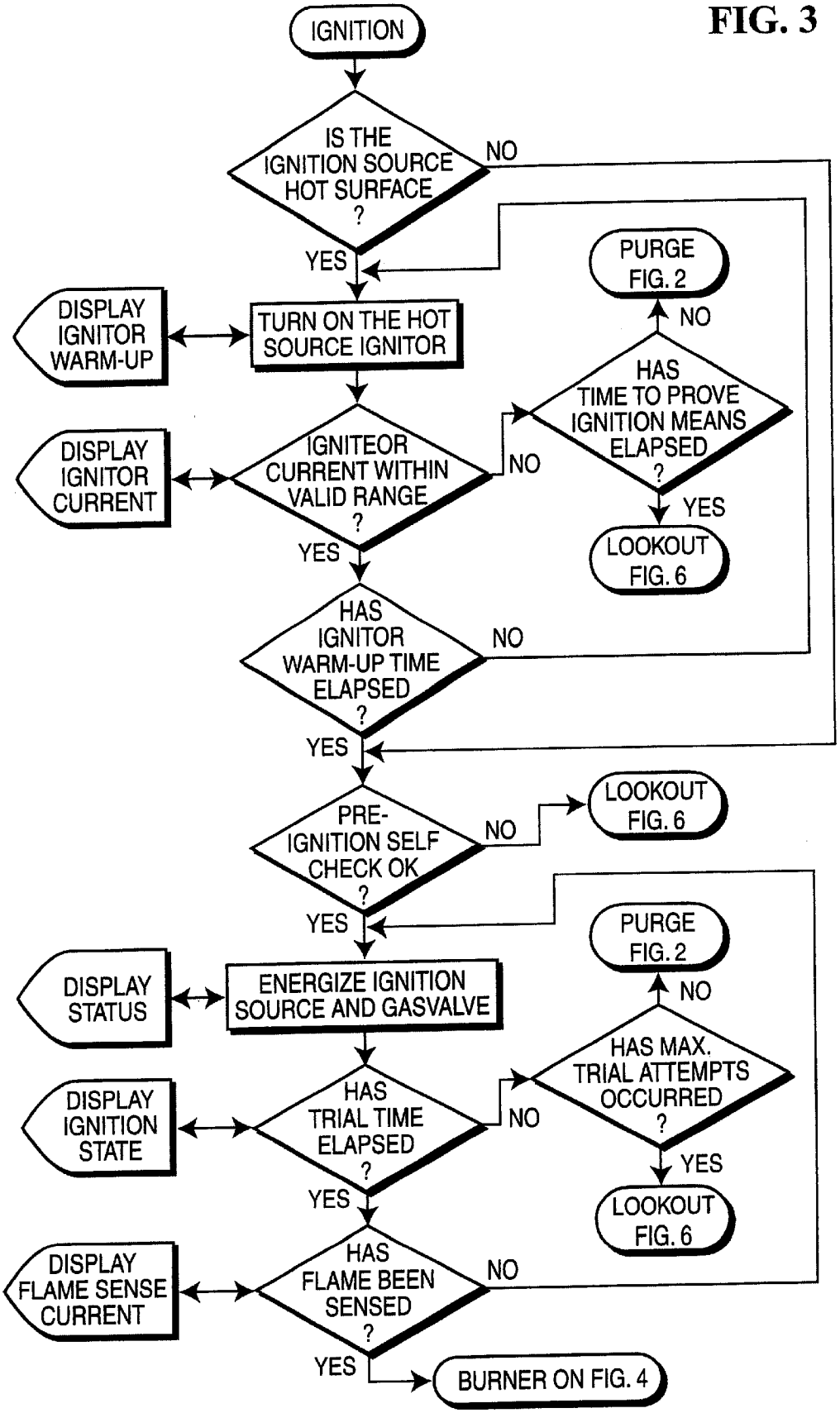
FIG. 3 is a flowchart of the IGNITION portion of the control portion of the control diagram of FIG. 2.
Figure 4:
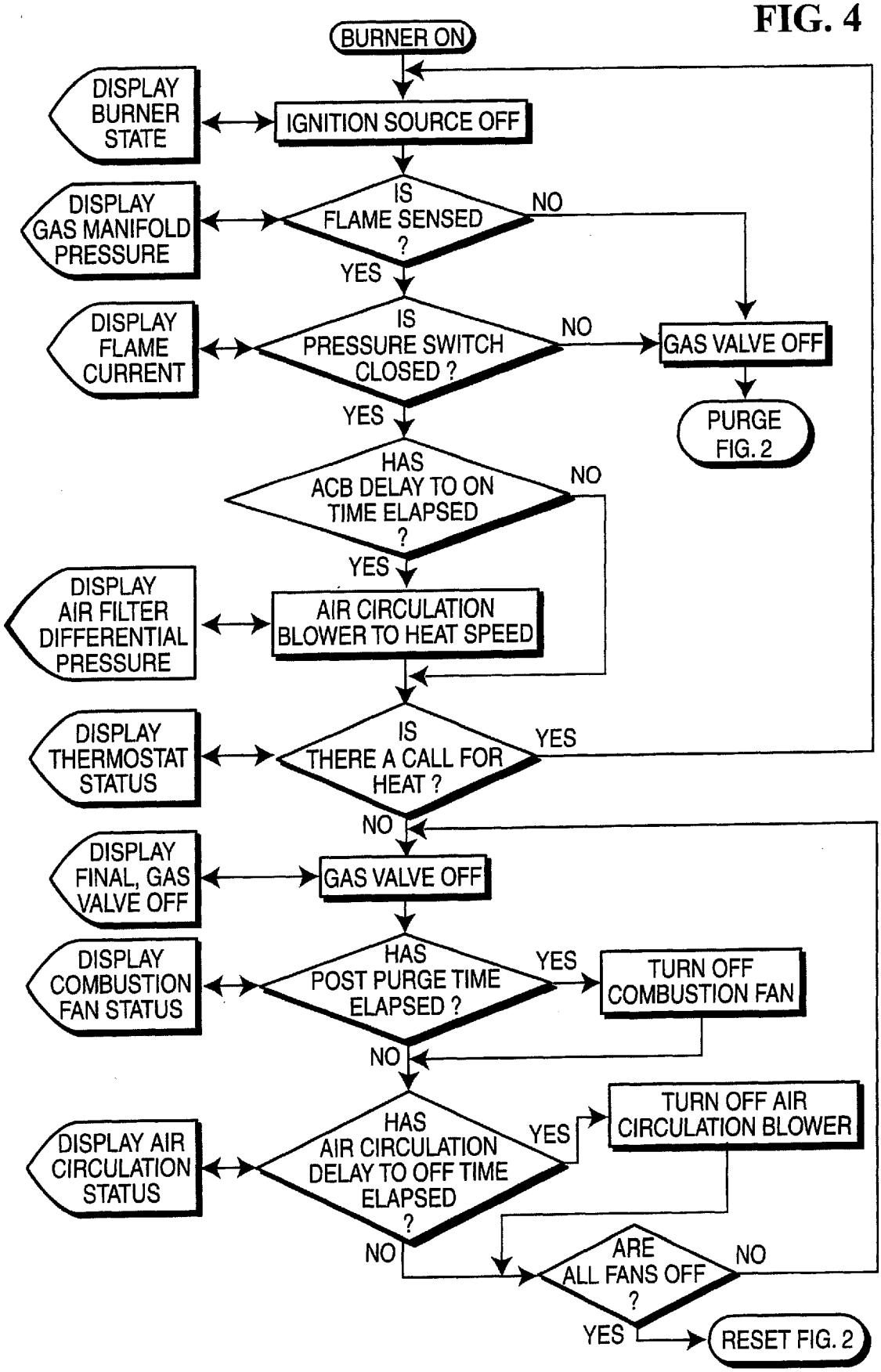
FIG. 4 is a flowchart of the BURNER portion of the control diagram of FIG. 3.
Figure 5:
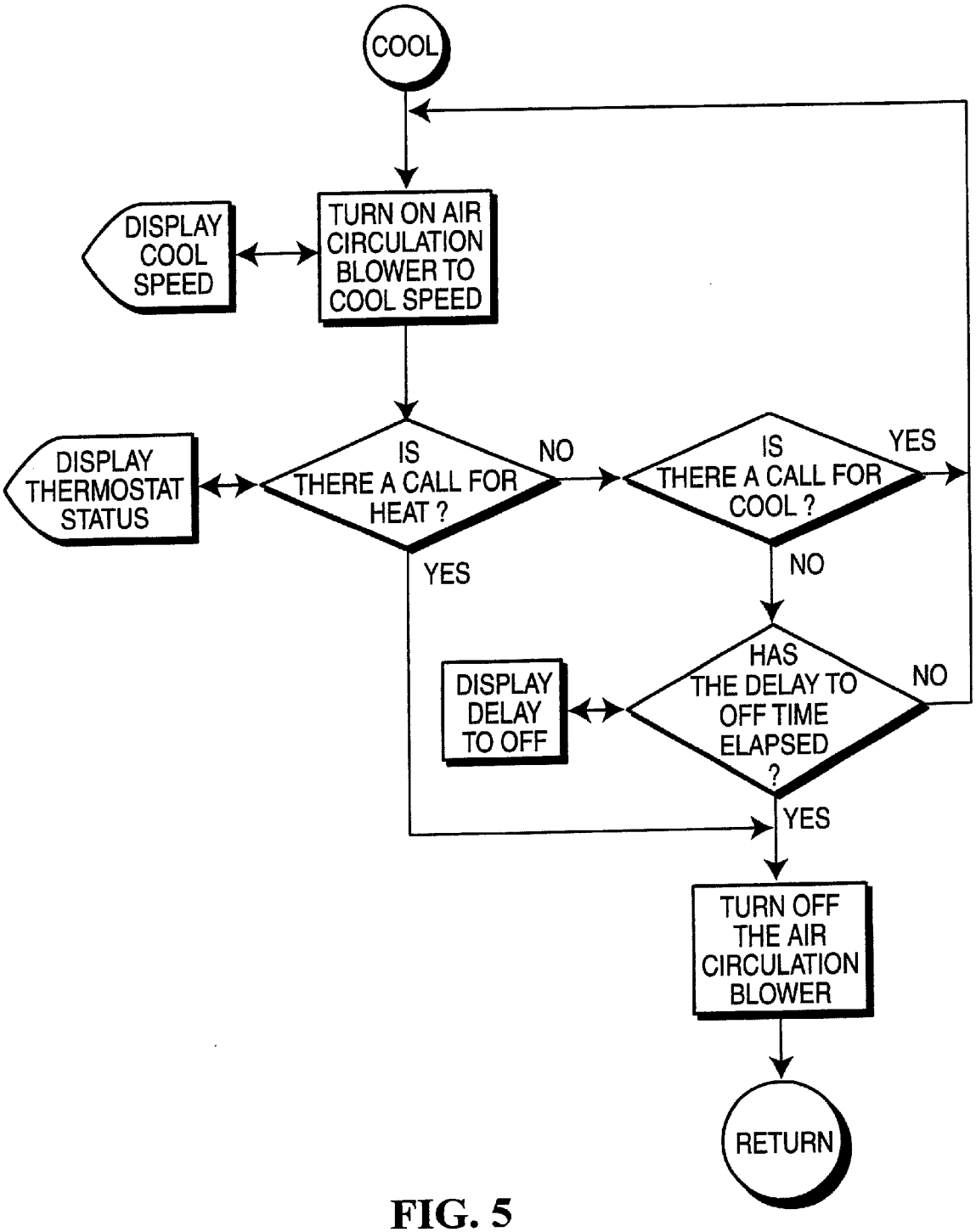
FIG. 5 is a flowchart of the COOL portion of the control diagram of FIG. 2.
Figure 6:
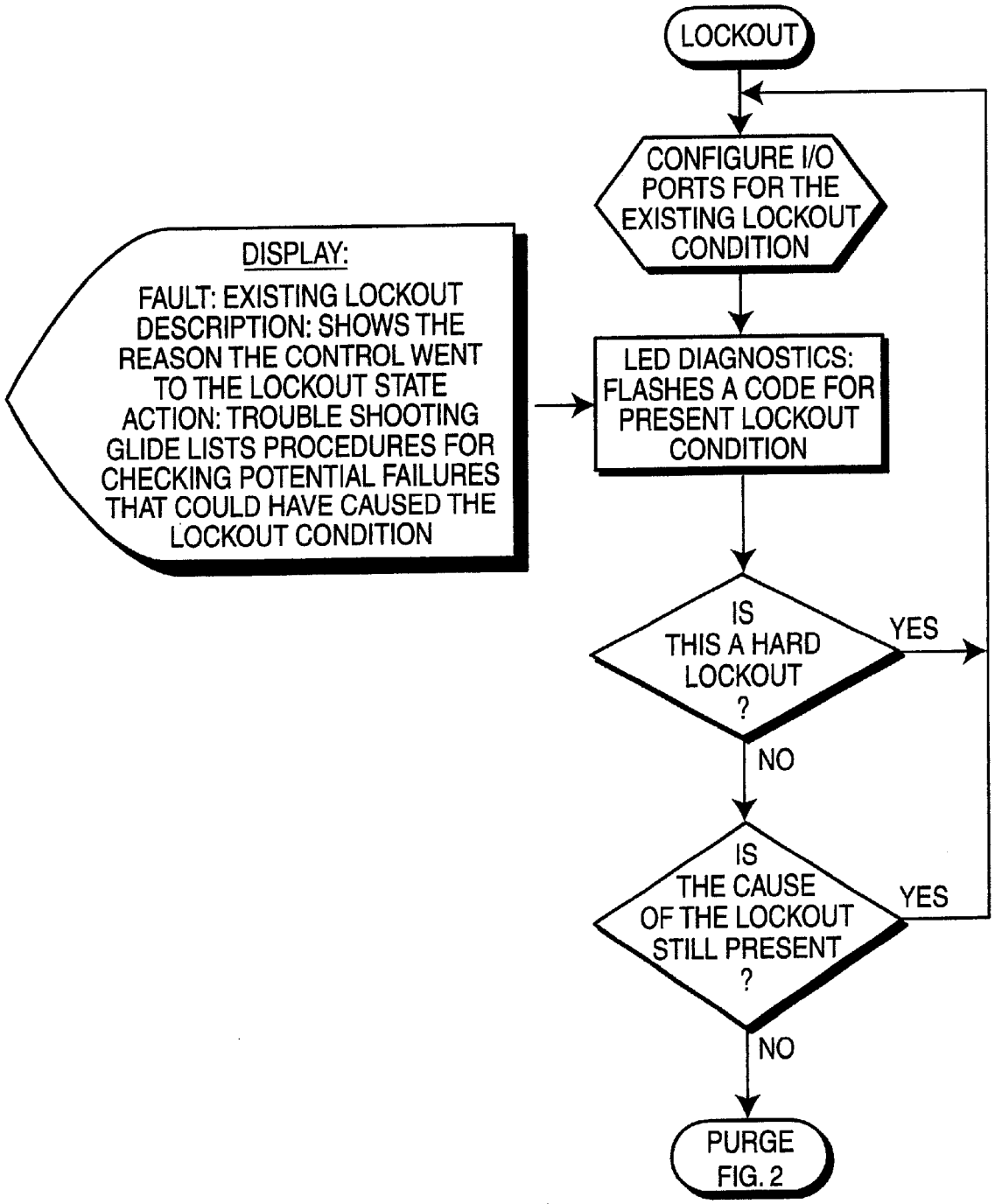
FIG. 6 is a flowchart of the LOCKOUT portion of the control diagram of FIG. 2.
Figure 7A:
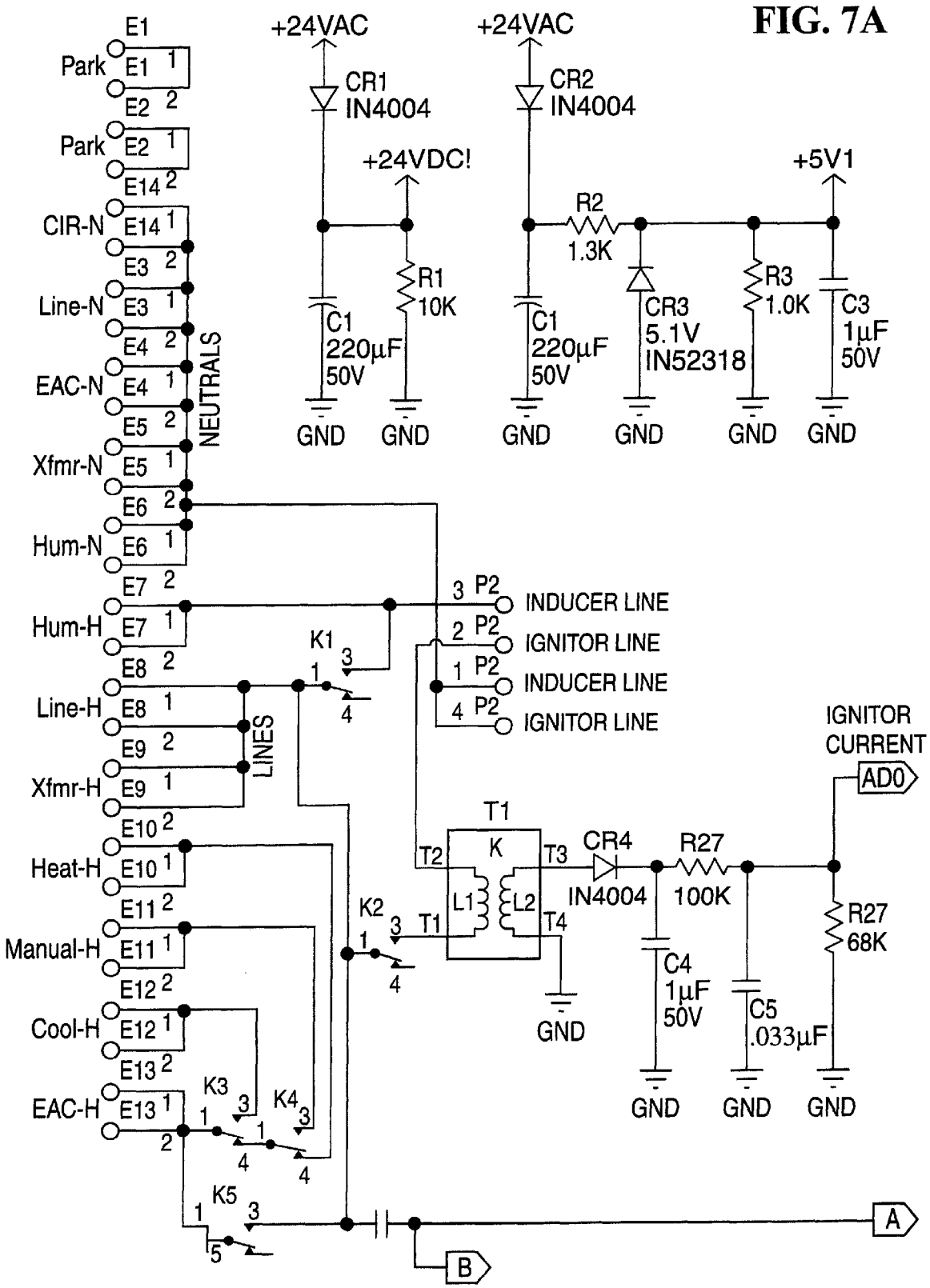
FIG. 7 is an electronic circuit diagram depicting one preferred embodiment of a device to perform the functions of the method of the present invention.
Figure 7B:
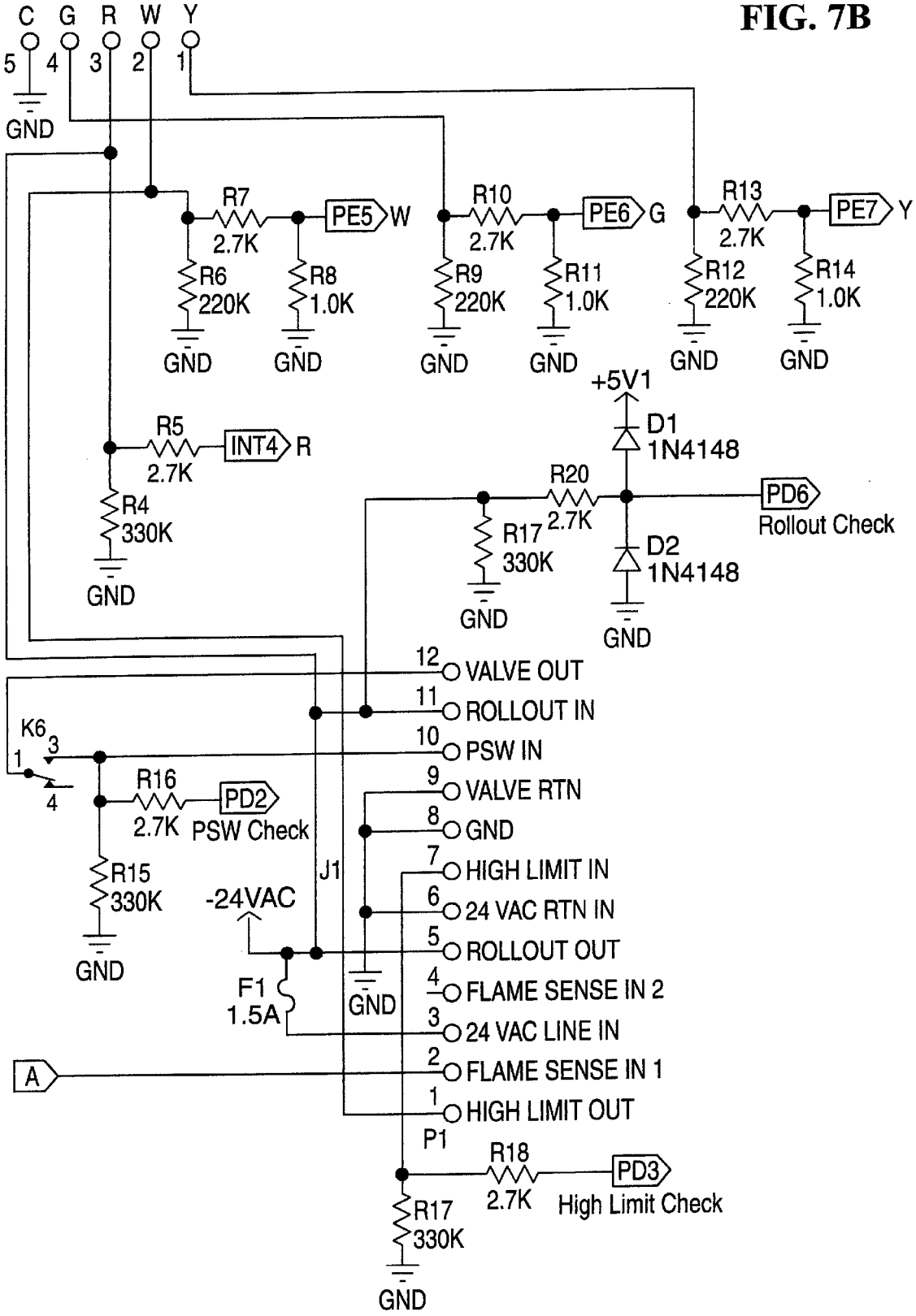
Figure 7C:
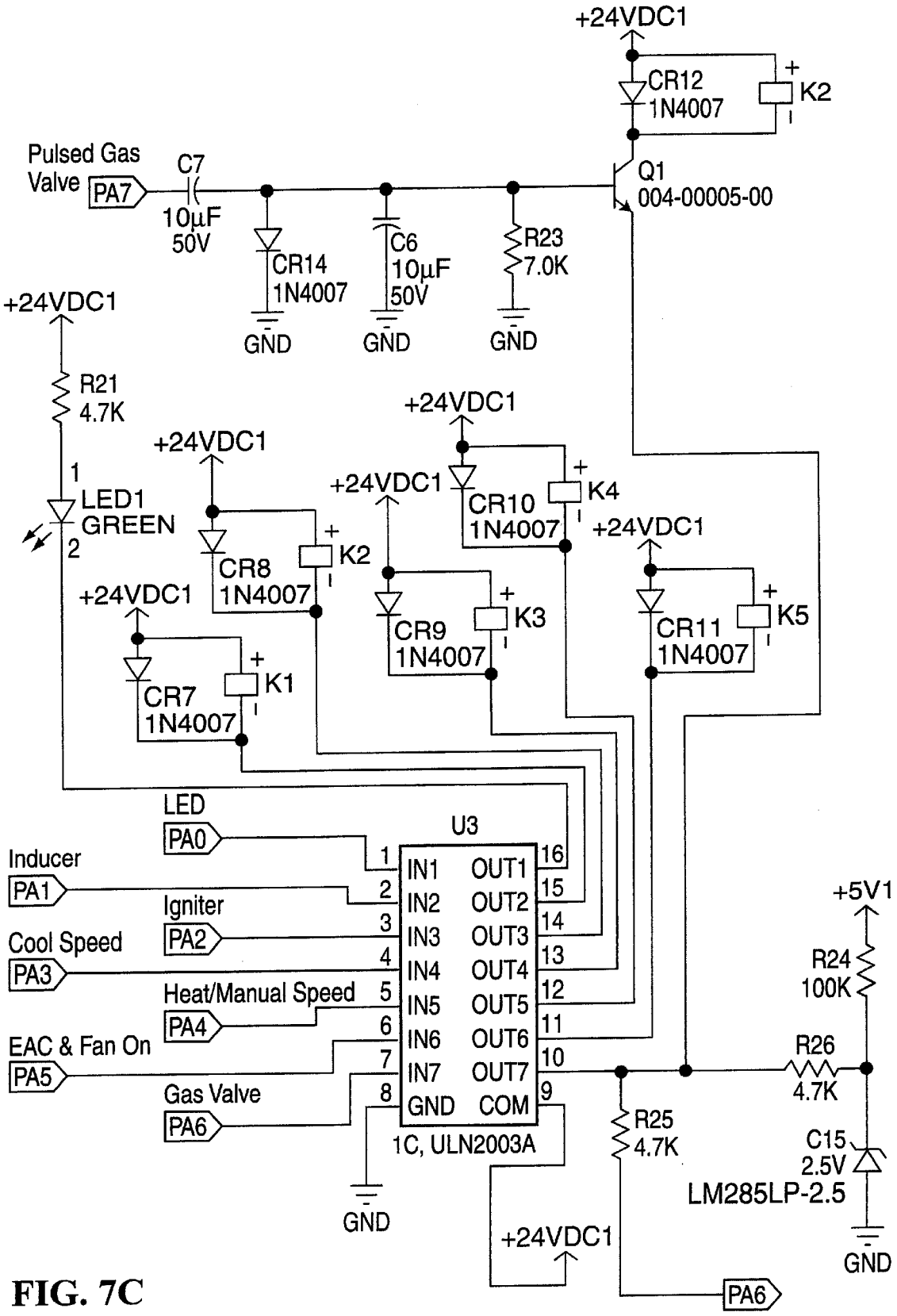
Figure 7D:
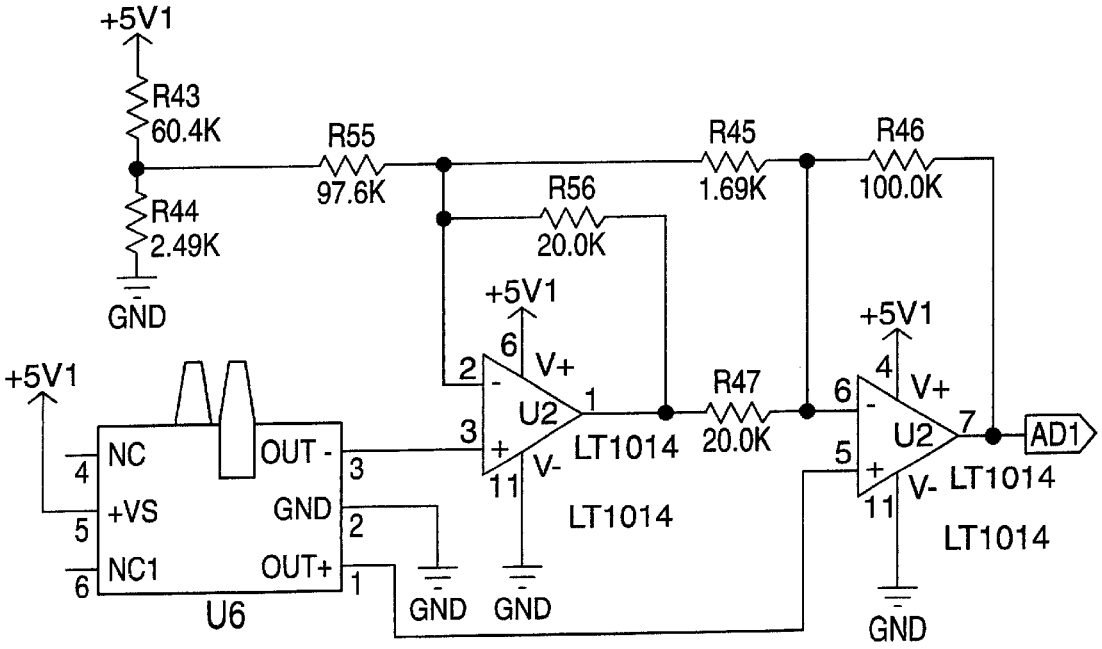
Figure 7D:
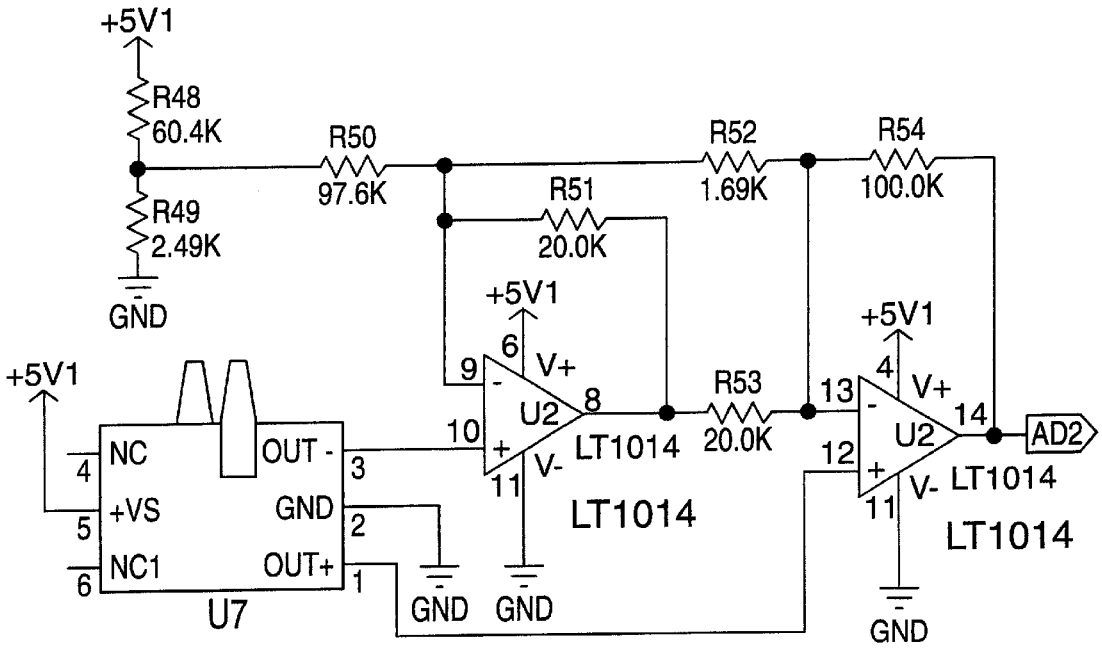
Figure 7E:
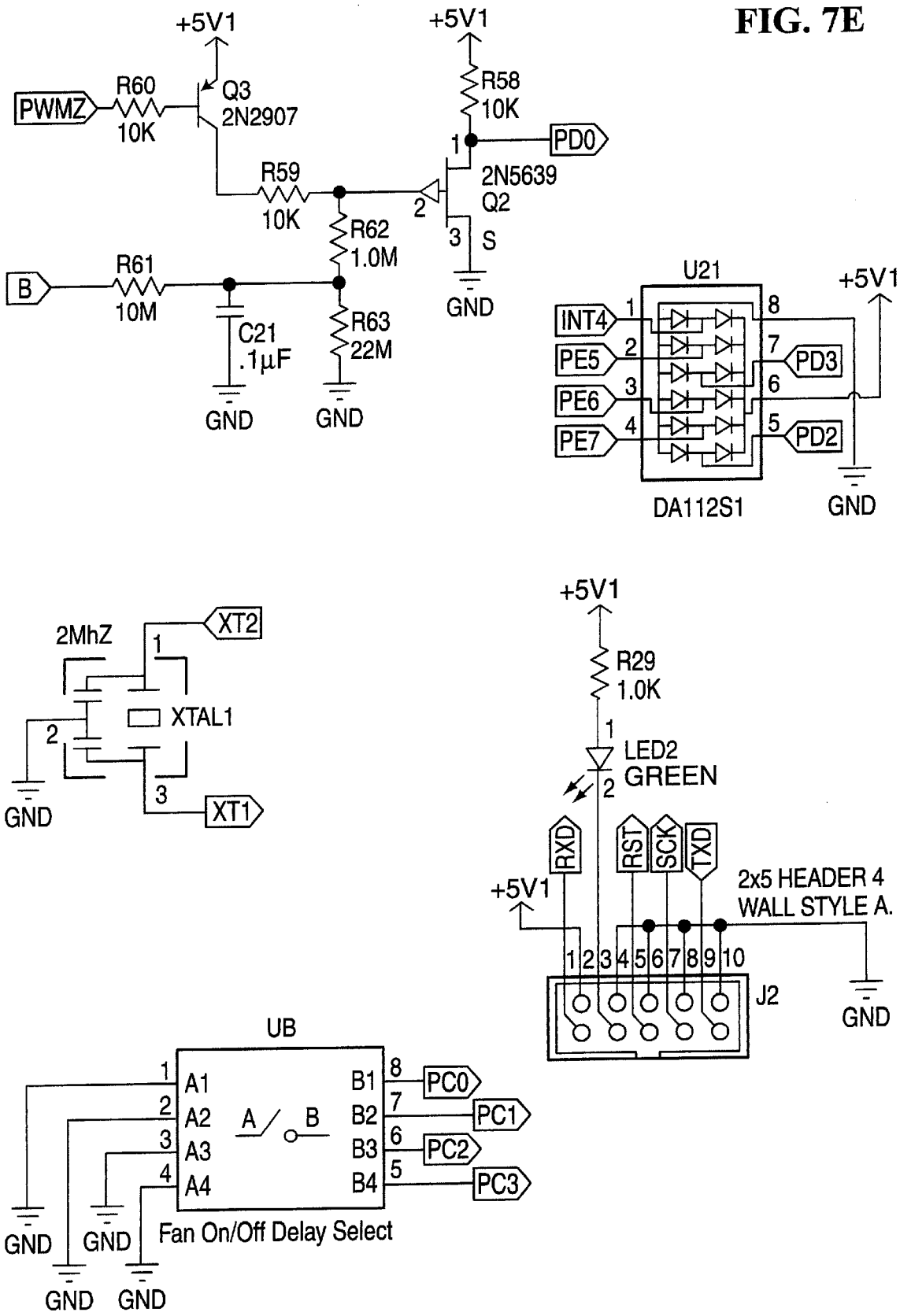
Figure 7F:
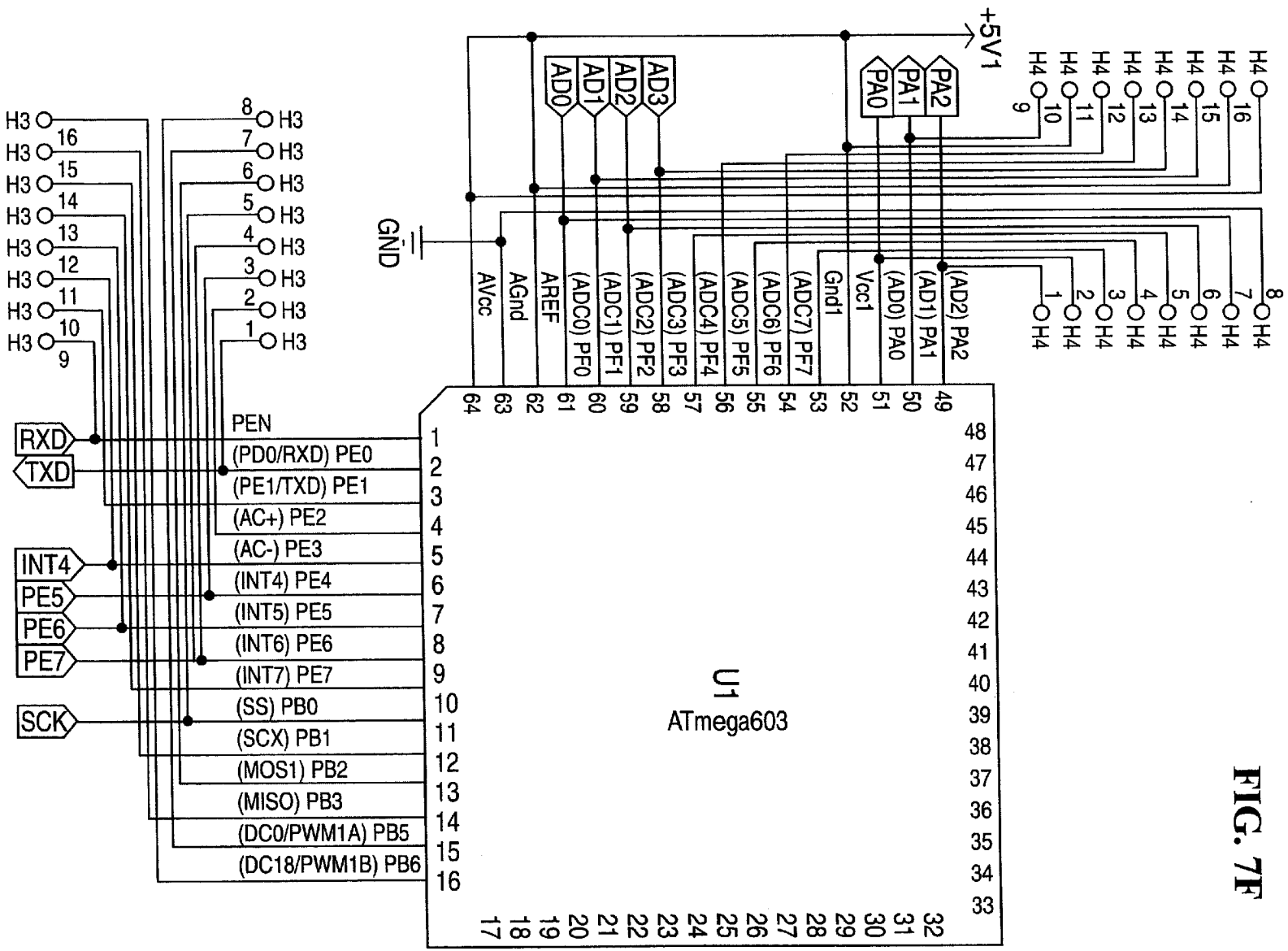
Figure 7G:
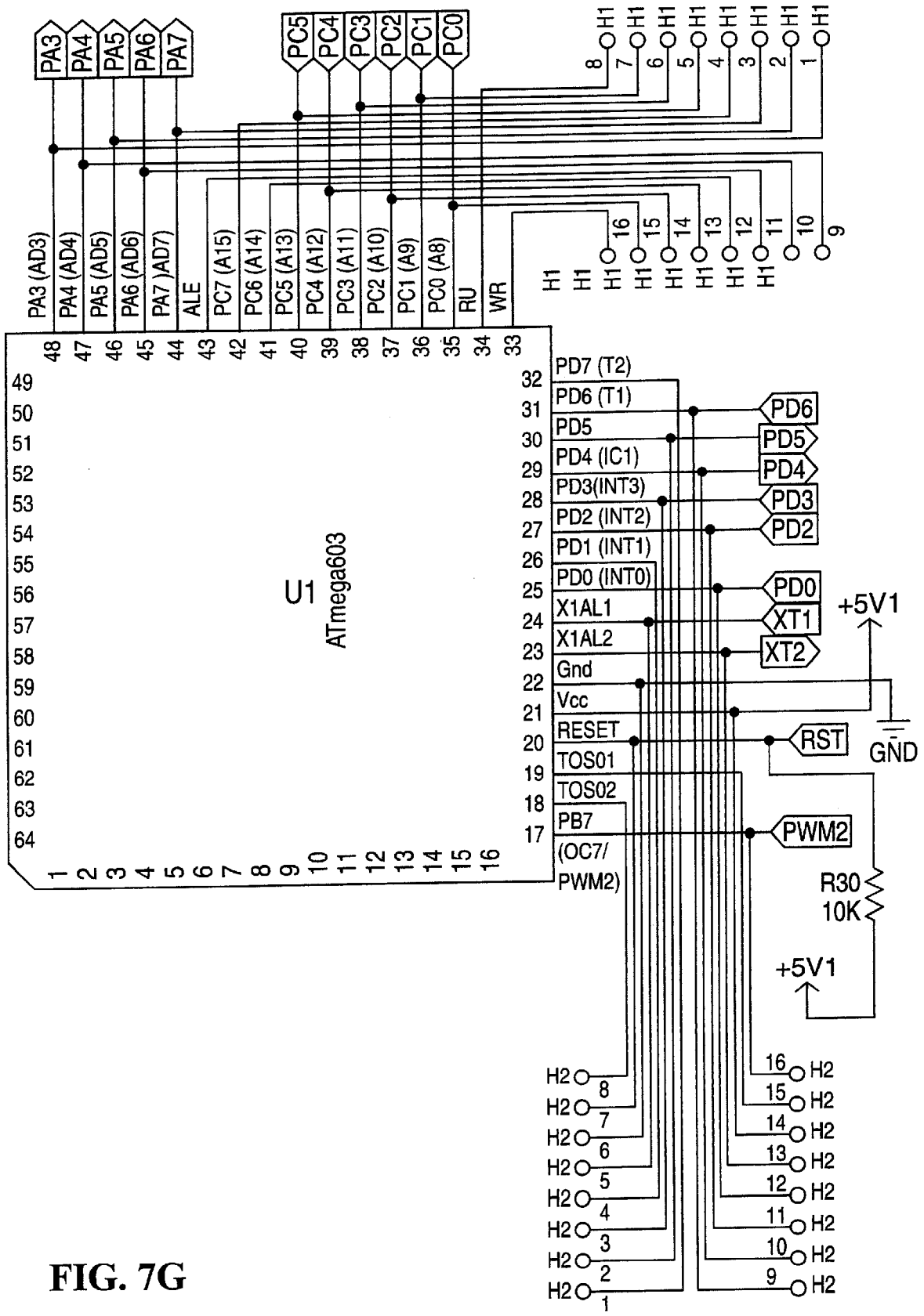
Figure 7H:
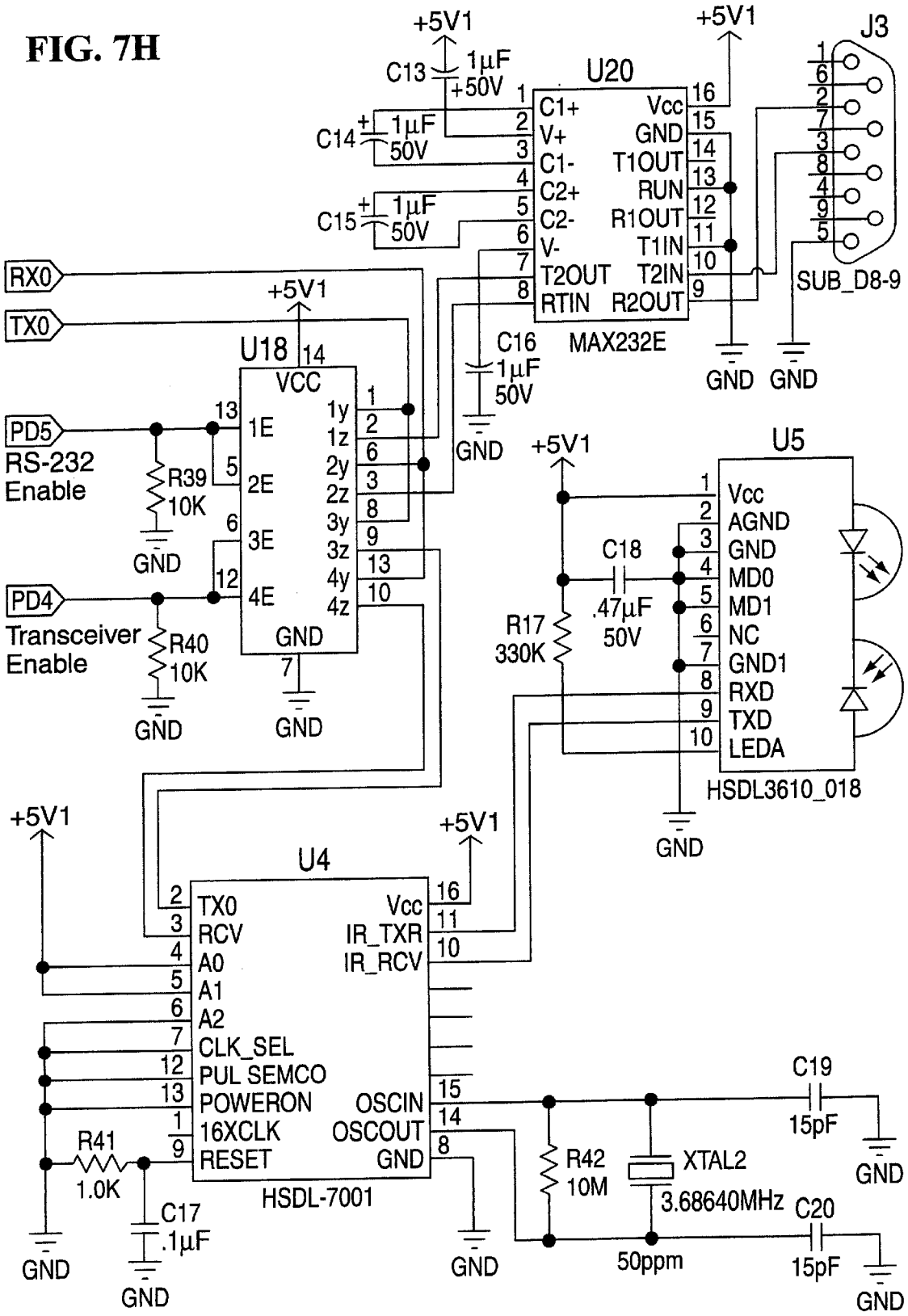

It is certified that error appears in the above-identified patent and that said Letters Patent is hereby corrected as shown below:

Drawings,
FIG. 3, delete "IGNITEOR" and replace with -- IGNITOR --; and delete "GASVALVE" and replace with -- GAS VALVE --.

Column 1,
Line 7, delete the duplicated sentence "A computer program listing appendix on compact disc is included in this application."

Column 10,
Line 55, delete "privde" and replace with -- provide --;

Column 12,
Line 53, delete "states" and replace with -- stages --.

Signed and Sealed this

Second Day of March, 2004

JON W. DUDAS
*Acting Director of the United States Patent and Trademark Office*